United States Patent [19]

Takizawa et al.

[11] Patent Number: 4,998,177

[45] Date of Patent: Mar. 5, 1991

[54] ELECTROMAGNETIC SOLENOID DRIVE APPARATUS IN A VEHICLE

[75] Inventors: Koji Takizawa; Yukio Takaishi; Noriyuki Suzuki; Norimasa Asai; Koki Imaeda; Shigeru Iguchi; Kenichi Onishi; Hisatoshi Ohta; Masamitsu Suzuki, all of Aichi, Japan

[73] Assignee: Kabushiki Kaisha Tokai Rika Denki Seisakusho, Aichi, Japan

[21] Appl. No.: 330,038

[22] Filed: Mar. 29, 1989

[30] Foreign Application Priority Data

Mar. 31, 1988 [JP] Japan ..... 63-43281

[51] Int. Cl.[5] ..... H01H 47/00

[52] U.S. Cl. ..... 361/154; 361/194; 361/205; 307/10.1

[58] Field of Search ..... 361/58, 86, 88, 91, 361/154, 153, 152, 187, 160, 194–196, 205; 307/10.1, 10.2, 10.3, 98–100, 130, 296.4, 362, 363, 546–549, 592, 598, 601; 340/456; 323/282, 284, 299, 901

[56] References Cited

U.S. PATENT DOCUMENTS

| | | | |
|---|---|---|---|
| Re. 24,671 | 7/1959 | Jensen | 323/284 |
| 922,218 | 5/1909 | Valkenburg | 361/187 X |
| 1,007,671 | 11/1911 | Buente et al. | 307/10.8 X |
| 1,909,855 | 5/1933 | Devine | 307/10.6 X |
| 3,396,314 | 8/1968 | Corson et al. | 361/154 |
| 3,590,334 | 6/1971 | Baker | 361/154 |
| 4,086,503 | 4/1978 | Fox et al. | 307/363 |
| 4,214,290 | 7/1980 | Sloan | 361/154 |

*Primary Examiner*—A. D. Pellinen
*Assistant Examiner*—David Osborn
*Attorney, Agent, or Firm*—Finnegan, Henderson, Farabow, Garrett & Dunner

[57] ABSTRACT

An electromagnetic solenoid drive apparatus for use in a vehicle for turning on an electromagnetic solenoid from a battery every time when a command switch is turned on comprises first and second resistors connected in series to each other on an electric line for flowing an electric current through the electromagnetic solenoid; a first switching element turned on in a state in which an output voltage of the battery is lower than a predetermined threshold voltage and short-circuiting both ends of the first resistor; a timer circuit operated for only a constant time in association with the turning-on operation of the command switch; and a second switching element turned on during only the operating period of the timer circuit and short-circuiting both ends of the second resistor.

12 Claims, 1 Drawing Sheet

ELECTROMAGNETIC SOLENOID DRIVE APPARATUS IN A VEHICLE

BACKGROUND OF THE INVENTION

The present invention relates to an electromagnetic solenoid drive apparatus for use in a vehicle for selectively turning on and driving an electromagnetic solenoid actuated by a battery as a power source.

In an automobile, for example, an electromagnetic solenoid is often used as a drive source of a so-called shift lock device or auto-door lock device, etc. In the shift lock device, for example, the electromagnetic solenoid is turned on only when an ignition key is turned on and a foot brake is operated in a state in which a shift lever for an automatic speed change gear is in a parking position.

The shift lock device also has a shift lock mechanism for locking or constraining the shift lever to be shifted from the parking position to another position in a state in which the electromagnetic solenoid is turned off. The shift lock device then additionally comprises a key interlock function to locate the shift lever reliably at the parking position when the ignition key is extracted from the device. In this case, the shift lock device further comprises an auxiliary electromagnetic solenoid turned on when the shift lever for the automatic speed change gear is located in a position except for the parking position, and a key lock mechanism for constraining the rotation of the ignition key to a LOCK position as an extractable position in a state in which the auxiliary electromagnetic solenoid is turned on. The electric power to the electromagnetic solenoid and to the auxiliary electromagnetic solenoid mentioned above is obtained form the battery mounted on the vehicle.

An output voltage of the battery is not constant at any time, but is changed depending on the charge state thereof, the strength of a load electic current and the like. Under this condition, since the power source of the electromagnetic solenoid is directly supplied from the battery through switches, etc., a drive voltage applied to the electromagnetic solenoid would accordingly be changed to a small or large value. As a result, in particular, when the output voltage of the battery is high, the drive voltage of the electromagnetic solenoid is also high so that a great operating noise is generated, which is uncomfortable in hearing. Further, the load electric current of the electromagnetic solenoid and thereby the heating amount thereof become undesirably large.

In order to solve such problems, in the conventional apparatus, it is considered that the drive voltage of the electromagnetic solenoid is restrained such that this drive voltage is less than a constant voltage by so-called a chopper control. However, in such a control, the structure of circuits becomes complicated, and a noise having a frequency according to a chopper control frequency is generted when the electromagnetic solenoid is held in a drive state.

SUMMARY OF THE INVENTION

Accordingly, an object of the present invention is to eliminate the above-described problems accompanying a conventional apparatus. More particularly, an object of the present invention is to provide an electromagnetic solenoid drive apparatus in a vehicle for reducing the noise and heat generated by the operation of an electromagnetic solenoid by a simplified construction of circuits of the apparatus.

The above and other objects have been achieved by the provision of an electromagnetic solenoid drive apparatus for use in a vehicle for turning on an electromagnetic solenoid from a battery every time when a command switch is turned on, which, according to the invention, provides first and second resistors connected in series to each other on an electric line for flowing an electric current through the electromagnetic solenoid, a first switching element turned on in a state in which an output voltage of said battery is lower than a predetermined threshold voltage and short-circuiting both ends of said first resistor, a timer circuit operated for only a constant time in association with the turning-on operation of said command switch, and a second switching element turned on during only the operating period of the timer circuit and short- circuiting both ends of said second resistor.

In the above-mentioned apparatus, when the command switch is turned on, the timer circuit is operated for only the constant time, the both ends of the second resistor are short-circuited by the second switching element during the operating period of the timer circuit. In this case, when the output voltage of the battery is lower than the predetermined threshold voltage, the both ends of the first resistor are also short-circuited by the first switching element. Since the both ends of each of the first and second resistors are thus short-circuited, the output voltage of the battery is directly provided to the electromagnetic solenoid and the operation of the electromagnetic solenoid is reliably performed in a state in which the output voltage of the battery is relatively low.

Thereafter, when a constant time has passed and the operation of the timer circuit is stopped, the short-circuiting state of the second resistor is released so that a low voltage partially divided by the second resistor is provided to the electromagnetic solenoid and the operating state thereof is held by the low voltage.

When the command switch is turned on while the output voltage of the battery is not less than the predetermined threshold voltage, the both ends of the first resistor are not short-curcuited by the first switching element and only the second resistor is short-circuited during the operating period of the timer circuit. Therefore, when the output voltage of the battery is relatively high, the output voltage of the battery is partially divided by the first resistor and is provided to the electromagnetic solenoid so that the operating voltage of the electromagnetic solenoid is reduced and an operating noise thereof is reduced.

Thereafter, when the constant time has passed and the operation of the timer circuit is stopped, the short-circuiting state of the second resistor is also released so that a low voltage partially divided by the first and second resistors is provided to the electromagnetic solenoid and the operating state of the electromagnetic solenoid is held by the low voltage.

DESCRIPTION OF THE PREFERRED EMBODIMENTS

An embodiment of an electromagnetic solenoid drive apparatus of the present invention applied to a shift lock device in a vehicle will now be described with reference to the accompanying drawings.

Figure 1:
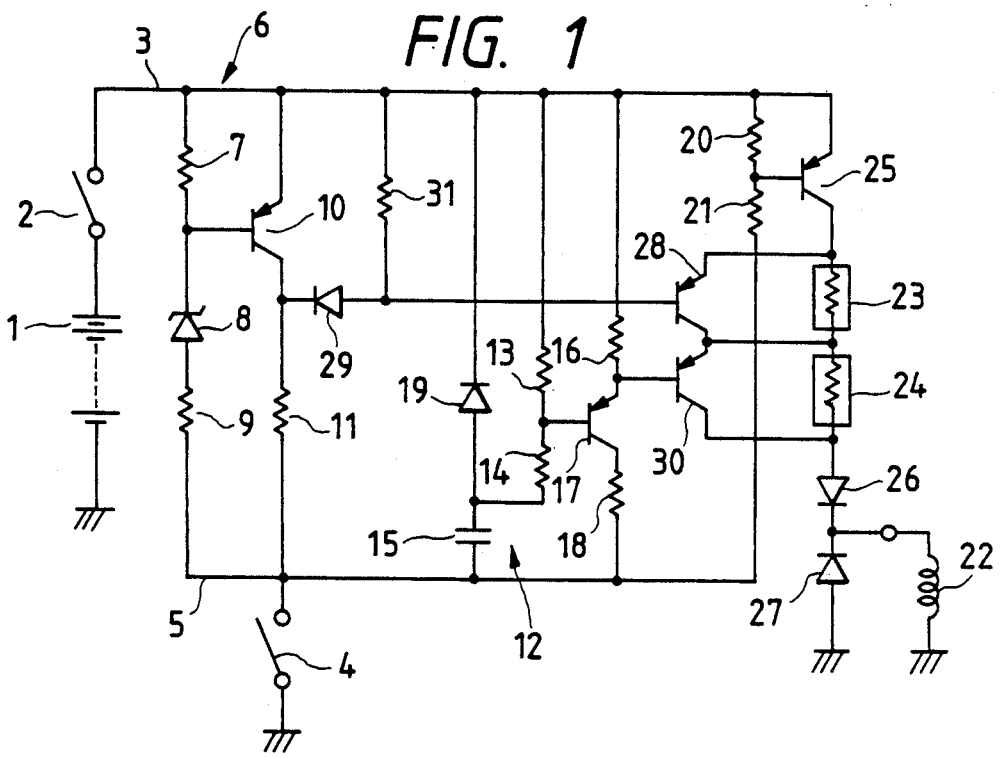
FIG. 1 is an electrical circuit diagram of an electromagnetic solenoid drive apparatus for use in a vehicle in accordance with an embodiment of the present invention.

FIG. 1 shows only main portions relating to the features of the present invention in the construction of electric circuits relating to the shift lock device.

The apparatus shown in FIG. 1 has a battery 1 having rated output voltage 12 V and an ACC contact 2 of an ignition switch. Power source line 3 is connected to the battery 1 when the ACC contact 2 is closed. A brake switch 4 as a command switch is closed when a foot brake is depressed. At this time, the brake switch 4 is connected to auxiliary power source line 5 at one end thereof and a ground at the other end thereof.

The apparatus also has a voltage detecting circuit 6. In the voltage detecting circuit 6, a resistor 7, a constant-voltage diode 8 having a polarity illustrated in this figure and a resistor 9 are connected in series to each other between the power source line 3 and the auxiliary power source line 5. Further, in the voltage detecting circuit 6, the series circuit composed of the resistor 7, diode 8 and resistor 9 is connected to a series circuit in which the emitter and collector of a transistor 10 of PNP-type and resistor 11 are connected in series to each other. The base of the transistor 10 is connected to the cathode of constant-voltage the diode 8. Zener voltage Vz of the constant-voltage diode 8 is set to 12 V corresponding to the rated output voltage of the battery 1.

Accordingly, in the voltage detecting circuit 6, when brake switch 4 is closed while the output voltage of the battery 1 is lower than 12 V as a threshold voltage, the transistor 10 is held in an off state without breaking down the constant-voltage diode 8 and the collector potential of transistor 10 is held at a low level.

Further, in voltage detecting circuit 6, when brake switch 4 is closed while the output voltage of battery 1 is not less than 12 V, the constant-voltage diode 8 is broken down and the transistor 10 is turned on so that the collector potential of the transistor 10 is inverted to a high level.

In a timer circuit 12 constructed as a CR timer, resistors 13, 14 and a capacitor 15 are connected in series to each other between the power source line 3 and the auxiliary power source line 5. In the timer circuit 12, the series circuit composed of the resistors 13, 14 and capacitor 15 is connected to a series circuit in which a resistor 16, the emitter and collector of a transistor 17 of PNP-type and a resistor 18 are connected in series to each other. The base of the transistor 17 is connected to a common connecting point of the resistors 13 and 14. In such a timer circuit 12, when the brake switch 4 is closed, the operation of the timer starts and the capacitor 15 is then charged through resistors 13 and 14.

Transistor 17 is held in the on state during the operating period of the timer until the charge voltage of the capacitor 15 reaches a constant level. Namely, the operating time of the timer is determined by a time constant of the resistors 13, 14 and the capacitor 15, and is set to about one second in this embodiment. The charge supplied to capacitor 15 is discharged through resistors 20 and 21 connected in series to each other between a diode 19 and the lines 3 and 5 in accordance with the opened state of brake switch 4.

The function of the shift lock mechanism is effectively fulfilled in a state in which an electromagnetic solenoid 22 is turned off, which is not shown in FIG. 1. Namely, in this state, the shift lever for the automatic speed change gear of a vehicle is locked so as not to be shifted from the parking position to another position. When electromagnetic solenoid 22 is actuated, the function of the shift lock mechanism is nullified and the above-mentioned locking state is released.

First and second resistors 23 and 24 are connected in series to each other and constitute a series circuit. This series circuit is connected at one end thereof to the power source line 3 through the emitter and collector of the transistor 25 of PNP-type, and at the other end thereof to the ground through a diode 26 having a polarity illustrated in FIG. 1 and the electromagnetic solenoid 22 connected in series to the diode 26. The base of transistor 25 is connected to a common connecting point of the resistors 20 and 21, and the electromagnetic solenoid 22 is connected in parallel to a flywheel diode 27.

A transistor 28 of PNP-type as a first switching element has an emitter and a collector respectively connected to both ends of the first resistor 23, and a base connected to the collector of the transistor 10 within the voltage detecting circuit 6 through a diode 29 having a polarity illustrated in FIG. 1. A transistor 30 of PNP-type as a second switching element has an emitter and a collector connected to both ends of the second resistor 24, and a base connected to the emitter of the transistor 17 within the timer circuit 12. In addition, a resistor 31 is connected between the anode of the diode 29 and the powere source line 3.

Figure 2:
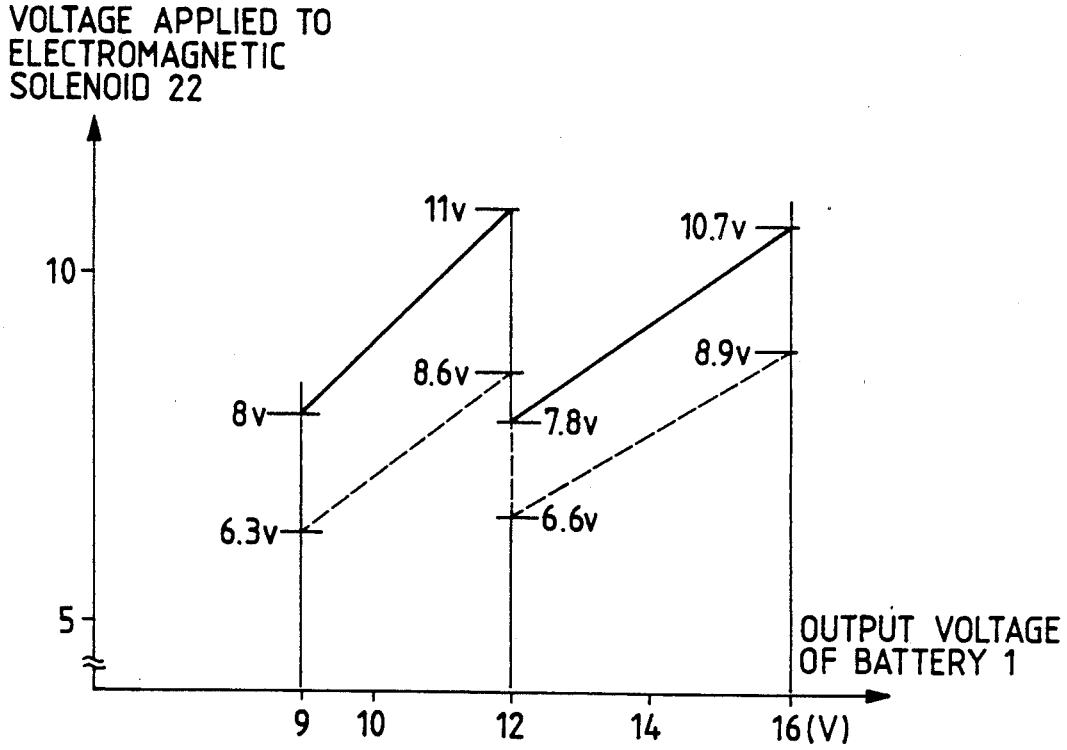
FIG. 2 is a view showing the voltage characteristics for explaining the operation of the electromagnetic solenoid drive apparatus.

The operation of the apparatus constructed above will now be described with reference not only to FIG. 1 but also to FIG. 2 showing the relation between the output voltage of the battery 1 and the drive or applied voltage of the electromagnetic solenoid 22.

When the ACC contact 2 of the ignition switch is closed, the power source line 3 is connected to the battery 1. In this state, while the brake switch 4 is opened, an electric current does not flow through the resistor 20 and 21 constituting a base bias circuit of the transistor 25. Accordingly, the transistor 25 is not turned on so that the electromagnetic solenoid 22 is turned off. In such a state in which the electromagnetic solenoid 22 is turned off, the function of the unillustrated shift lock mechanism is effectively fulfilled so that the operation of the shift lever is locked. However, when the foot brake is thereafter depressed to turn on the brake switch 4, the electromagnetic solenoid 22 is operated by a voltage different in accordance with the output voltage of the battery 1 so that the function of the shift lock mechanism is nullified as follows.

(1) When the output voltage of the battery 1 is lower than 12 V, the following opertion is performed.

In this case, the timer circuit 12 performs the timer operation only during a predetermined constant time such as one second in accordance with the turning-on operation of brake switch 4, and the transistor 17 is held in the turning-on state during this time interval. Accordingly, the transistor 30 is correspondingly turned on so that both ends of the second resistor 24 are short-circuited by the transistor 30. Further, in the voltage detecting circuit 6, since the constant-voltage diode 8 is not broken down, the transistor 10 remains turned off and the transistor 28 is correspondingly held in the closed state so that both ends of first resistor 23 are short-circuited by the transistor 28.

Thus, since both the ends of each of the first and second resistors 23 and 24 are short-circuited, the output voltage of the battery 1 is directly applied to the electromagnetic solenoid 22 from the power source line 3 through the transistors 25, 28, 30 and the diode 26. In this case, the voltage drop in the transistors 25, 28, 30, the diode 26, etc. is a low one about 1.0 V as seen from FIG. 2. As a result, although the output voltage of the battery 1 is low, the electromagnetic solenoid 22 is reliably operated by a relatively high voltage.

Thereafter, when the constant time has passed and the timer operation of the timer circuit 12 stops, the transistors 17 and 30 are correspondingly sequentially turned off so that the short-circuiting state of the second resistor 24 is released and the electromagnetic soleniod 22 is turned on from the power source line 3 the through transistors 25, 28, the second resistor 24 and the diode 26. Accordingly, a low voltage partially divided by the second resistor 24 is applied to the electromagnetic solenoid 22 and the operating state thereof is held by the low voltage, thereby restraining the heat generated from the electromagnetic solenoid 22 etc., as small as possible.

When the electromagnetic solenoid 22 is held in the turning-on state, the electric current continuously flow through the electromagnetic solenoid 22 so that no noise is generated as in the conventional apparatus performing the chopper control.

(2) when the output voltage of the battery 1 is not less than 12 V, the following operation is performed.

Even in this case, the timer circuit 12 performs the timer operation only during the constant time such as one second in accordance with the closed state of the brake switch 4, and the transistors 17 and 30 are turned on during this time interval so that both ends of the second resistor 24 are short-circuited by the transistor 30. Further, in this case, since the constant-voltage diode 8 is broken down in the voltage detecting circuit 6, the transistor 10 is now turned on. Accordingly, the transistor 28 is held in the off state and both ends of the first resistor 23 are not short-circuited.

Since only the second resistor 24 is short- circuited, the output voltage of the battery 1 is provided to the electromagnetic solenoid 22 from the power source line 3 through the transistor 25, the first resistor 23, the transistor 30 and the diode 26. Therefore, a low voltage partially divided by the first resistor 23 is applied to the electromagnetic solenoid 22 so that the electromagnetic solenoid 22 is operated by the relatively low voltage although the output voltage of the battery 1 is high. Accordingly, an operating noise caused by the operation of the electromagnetic solenoid 22 is sufficiently reduced. Thereafter, when the constant time has passed and the timer operation of the timer circuit 12 stops, the transistors 17 and 30 are correspondingly sequentially turned off so that the short-circuiting state of the second resistor 24 is released and an electric current flows through the electromagnetic solenoid 22 from the power source line 3 through the transistor 25, the first resistor 23, the second resistor 24 and the diode 26. Therefore, a low voltage partially divided by the first and second resistors 23 and 24 connected in series to each other is applied to the electromagnetic solenoid 22, and the operating state of the electromagnetic solenoid 22 is held by the low voltage, thereby restraining the heat generated by the electromagnetic solenoid 22, etc., as small as possible. Even when the operating state of the electromagnetic solenoid 22 is held, no noise is generated as in the conventional apparatus for performing the chopper control.

The present invention is not limited to the embodiment mentioned above and illustrated in the figures, but may be variously modified within the features of the present invention. For example, the present invention is not limited to the electromagnetic solenoid for shift lock in an automobile, but can be applied to an electromagnetic solenoid generally used for a vehicle.

As mentioned above, in the electromagnetic solenoid drive apparatus in a vehicle of the present invention, an electromagnetic solenoid is turned on from the battery every time when a command switch is turned on. The apparatus has a simplified circuit construction composed of first and second resistors, first and second switching elements, and a timer circuit, etc. By such a simplified circuit construction, when the electromagnetic solenoid is operated, the operating noise thereof is effectively restrained and the heat generated from the electromagnetic solenoid can sufficiently be restrained, and noises are reduced in a period in which the operating state of the electromagnetic solenoid is held, thereby providing the practical effects for the apparatus.

What is claimed is:

1. An electromagnetic solenoid drive apparatus for use in a vehicle, comprising:

a power source that applies a voltage on a power source line;

a command switch;

an electromagnetic solenoid actuated by said power source every time when said command switch is turned on;

first and second resistors connected in series to each other, both said first and second resistors being connected to said power source line;

first means for short-circuiting both ends of said first resistor, said first short-circuiting means being turned on in a state in which said voltage from said power source is lower than a predetermined value;

second means for short-circuiting both ends of said second resistor; and means for actuating said second short-circuiting means only for a predetermined constant time in accordance with the turned-on of said command switch, wherein said second short-circuiting means actuating means comprises:

first series including third and fourth resistors and a capacitor connected in series with each other; and second series including fifth and sixth resistors and a transistor connected in series with each other, said transistor is provided between said fifth and sixth resistors, such that each said third and fourth series is connected to said power source line, and said third and fourth resistors are commonly connected to a base of said transistor.

2. The electromagnetic solenoid drive apparatus of claim 1, wherein said transistor is of PNP type.

3. The electromagnetic solenoid drive apparatus of claim 1, wherein said predetermined constant time is about one second.

4. The electromagnetic solenoid drive apparatus of claim 1, further comprising means for detecting said voltage of said power source.

5. The electromagnetic solenoid drive apparatus of claim 4, wherein said voltage detecting means comprises:

third series including seventh and eighth resistors and a diode connected in series with each other, said diode being provided between said seventh and eighth resistors; and fourth series including a second transistor and a ninth resistor connected in series to each other, wherein a common connecting point of said seventh resistor and said diode is connected to a base of said second transistor, each said third and fourth series is connected to said power source line.

6. The electromagnetic solenoid drive apparatus of claim 5, wherein said diode is a constant-voltage Zener diode having a voltage which is set corresponding to said voltage of said power source.

7. the electromagnetic solenoid drive apparatus of claim 6, wherein said Zener voltage of said constant-voltage diode is 12 V.

8. The electromagnetic solenoid drive apparatus of claim 1, wherein said voltage of said power source is 12 V.

9. the electromagnetic solenoid drive apparatus of claim 1, further comprising an ingnition switch for selectively applying said voltage of said power source to said power source line.

10. The electromagnetic solenoid drive apparatus of claim 1, wherein said command switch is actuated in accordance with a depression of a foot brake of the vehicle.

11. The electromagnetic solenoid drive apparatus of claim 1, wherein said predetermined value of said voltage is 12 V.

12. The electromagnetic solenoid drive apparatus of claim 1, wherein each said first and second short- circuiting means comprises a transistor of PNP type.

* * * * *